US008167590B1

(12) United States Patent
Vidal et al.

(10) Patent No.: US 8,167,590 B1
(45) Date of Patent: May 1, 2012

(54) PEDESTAL FAN DEVICE

(76) Inventors: Scott E. Vidal, Okeechobee, FL (US); Merlene F. Vidal, Okeechobee, FL (US)

( * ) Notice: Subject to any disclaimer, the term of this patent is extended or adjusted under 35 U.S.C. 154(b) by 324 days.

(21) Appl. No.: 12/687,381

(22) Filed: Jan. 14, 2010

(51) Int. Cl.
*F04B 35/04* (2006.01)

(52) U.S. Cl. ..... 417/423.15; 417/423.14; 417/424.1

(58) Field of Classification Search ..... 417/410.1, 417/423.1, 423.14, 423.15, 424.1, 313; 416/244 R
See application file for complete search history.

(56) References Cited

U.S. PATENT DOCUMENTS

| | | | | | |
|---|---|---|---|---|---|
| 1,383,477 | A | * | 7/1921 | Menk | 126/110 R |
| 1,645,140 | A | * | 10/1927 | Herbruck | 454/329 |
| 1,743,994 | A | * | 1/1930 | Waterbury | 454/329 |
| 1,875,683 | A | * | 9/1932 | Waterbury | 454/329 |
| 1,982,465 | A | * | 11/1934 | Crafton | 261/104 |
| 2,165,650 | A | * | 7/1939 | Pfautsch | 454/208 |
| 2,679,202 | A | * | 5/1954 | Koff | 454/269 |
| 2,824,575 | A | | 2/1958 | Rosen | |
| 3,359,883 | A | | 12/1967 | Murphy | |
| 4,020,753 | A | | 5/1977 | Efstratis | |
| 4,250,800 | A | | 2/1981 | Brockmeyer | |
| D280,339 | S | | 8/1985 | Harwell | |
| 4,846,399 | A | * | 7/1989 | Asselbergs | 236/49.4 |
| 4,852,470 | A | * | 8/1989 | Corriveau | 454/338 |
| 4,967,569 | A | | 11/1990 | Machen et al. | |
| D316,599 | S | | 4/1991 | Wang | |
| 5,722,483 | A | | 3/1998 | Gibson | |
| D399,941 | S | | 10/1998 | Nystrom | |
| 6,322,443 | B1 | | 11/2001 | Jackson | |
| 7,966,837 | B2 | * | 6/2011 | El-Galley et al. | 62/186 |
| 2009/0061758 | A1 | * | 3/2009 | Yeung et al. | 454/329 |

FOREIGN PATENT DOCUMENTS

| | | | | |
|---|---|---|---|---|
| JP | 01225840 | A | * | 9/1989 |
| JP | 10281517 | A | * | 10/1998 |
| JP | 2002061909 | A | * | 2/2002 |
| JP | 2002243231 | A | * | 8/2002 |
| JP | 2006077752 | A | * | 3/2006 |
| JP | 2009121269 | A | * | 6/2009 |

* cited by examiner

*Primary Examiner* — Devon C Kramer
*Assistant Examiner* — Thomas Fink

(57) ABSTRACT

A pedestal fan device having a base; a first support extending upwardly from the base; a fan housing mounted to the first support component, wherein an open hole is disposed in the front surface of the fan housing and a plurality of fan blades is disposed in the inner cavity of the fan housing, the plurality of fan blades is operatively connected to a motor; the base is fluidly connected to the first support component and the first support component is fluidly connected to the fan housing so as to allow air from an air source to circulate; a first door component disposed in the back surface of the fan housing; a second door component disposed in a side portion of the base; and a third door component disposed in a bottom surface of the base.

20 Claims, 7 Drawing Sheets

FRONT VIEW

REAR VIEW

PEDESTAL FAN DEVICE

FIELD OF THE INVENTION

The present invention is directed to a fan, more particularly to a rotatable pedestal fan that can be used to draw hot or cold air from a heating-ventilating-air conditioning (HVAC) system and circulate the air in a room.

BACKGROUND OF THE INVENTION

Fans are commonly used as a means of cooling a room in the absence or in combination with air conditioning. The present invention features a modified fan with increased versatility. The fan device of the present invention may be used in front of a space heater or in front of/on top or a baseboard heating-ventilating-air conditioning (HVAC) system. Air from the HVAC system or space heater can be drawn through the base of or back of the fan device and circulated via fan blades.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
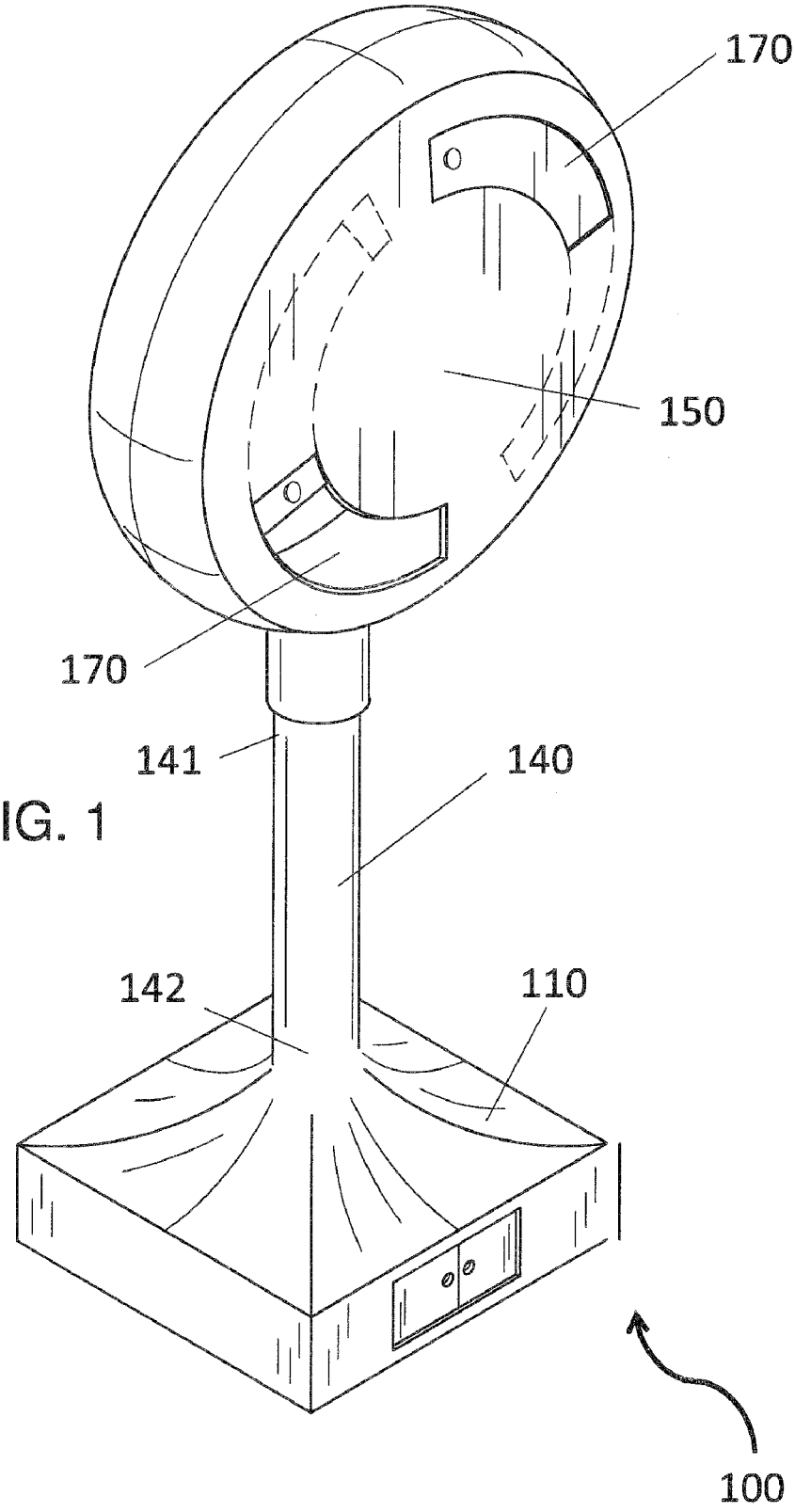
FIG. 1 is a rear perspective view of the fan device of the present invention.

Referring now to FIGS. 1-8, the present invention features a pedestal fan device 100 for circulating air from an air source (e.g., including but not limited to a heating-ventilating-air conditioning (HVAC) system, a space heater, a window, a room, etc.).

The fan device 100 comprises a base 110 with a first support component 140 (e.g., tubular) extending upwardly from the base 110. The base 110 and/or the first support component 140 may be generally hollow, each comprising an inner cavity. A fan housing 150 is mounted to the first support component 140. In some embodiments, the first end 141 of the first support component 140 is attached to the base 110 and the fan housing 150 is attached to the second end 142 of the first support component 140. The base 110 is fluidly connected to the first support component 140, and the first support component 140 is fluidly connected to the fan housing 150. For example, air can circulate from the base 110 (e.g., in the inner cavity of the base 110) through the support component 140 (e.g., through the inner cavity of the base 110) and through to the fan housing 150 (e.g., in the inner cavity of the fan housing 150).

The fan housing 150 is similar in appearance to a fan housing of a standard pedestal fan, which is well known to one of ordinary skill in the art. For example, the fan housing 150 has a generally hollow an inner cavity, a front surface, and a back surface. An open hole 155 is disposed in the front surface, wherein a grate 158 partially covers the open hole 155. A plurality of fan blades 160 is rotatably attached to an axle 152, the axle 152 being fixedly attached in the inner cavity of the fan housing 150. The fan blades 160/axle are operatively connected to a motor that drives the rotation of the fan blades 160. The motor is operatively connected to a power source (e.g., a battery, an electrical outlet). The device 100 may further comprise a rotating motor for rotating the fan housing in a first direction and a second direction with respect to the first support component 140. Rotating motors of this kind are well known to one of ordinary skill in the art.

Disposed in the back surface of the fan housing 150 is a first door component 170. The first door component 170 can move between an open position and a closed position respectively allowing and preventing access (e.g., air access) to the inner cavity of the fan housing 150. In some embodiments, the first door component 170 is a sliding door or a pair of sliding doors (see FIG. 1). In some embodiments, the first door component 170 is pivotally attached to the back surface of the fan housing 150. The first door component 170 is not limited to the aforementioned examples. As shown in FIG. 1, two first door components 170 are disposed in the fan housing 150. The door components 170 are positioned around the outer edge of the back surface of the fan housing 150.

Figure 2:
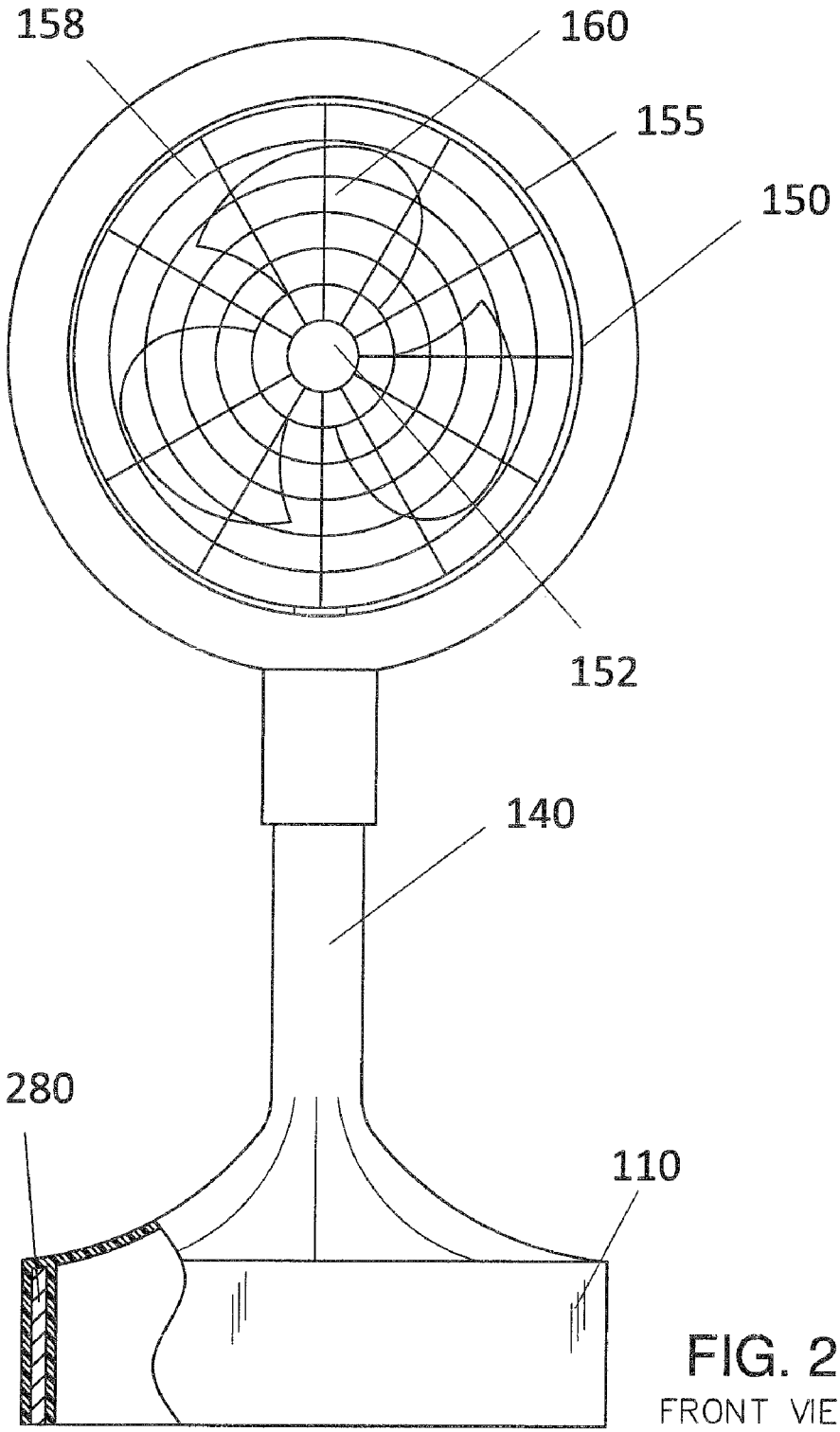
FIG. 2 is a front view and partial cross sectional view of the fan device of FIG. 1.

As shown in FIG. 2, a weight 280 may be disposed in the base 110 for helping keep the fan device 100 in an upright position. The weight 280 may also help prevent tipping of the fan device 100. The base 110 may be constructed in a variety of shapes. For example, in some embodiments, the base 110 is constructed in a generally square shape, a generally circular shape, a generally triangular shape, a generally oval shape, a generally pentagonal shape, etc., an irregular shape, the like, or a combination thereof.

Figure 3:
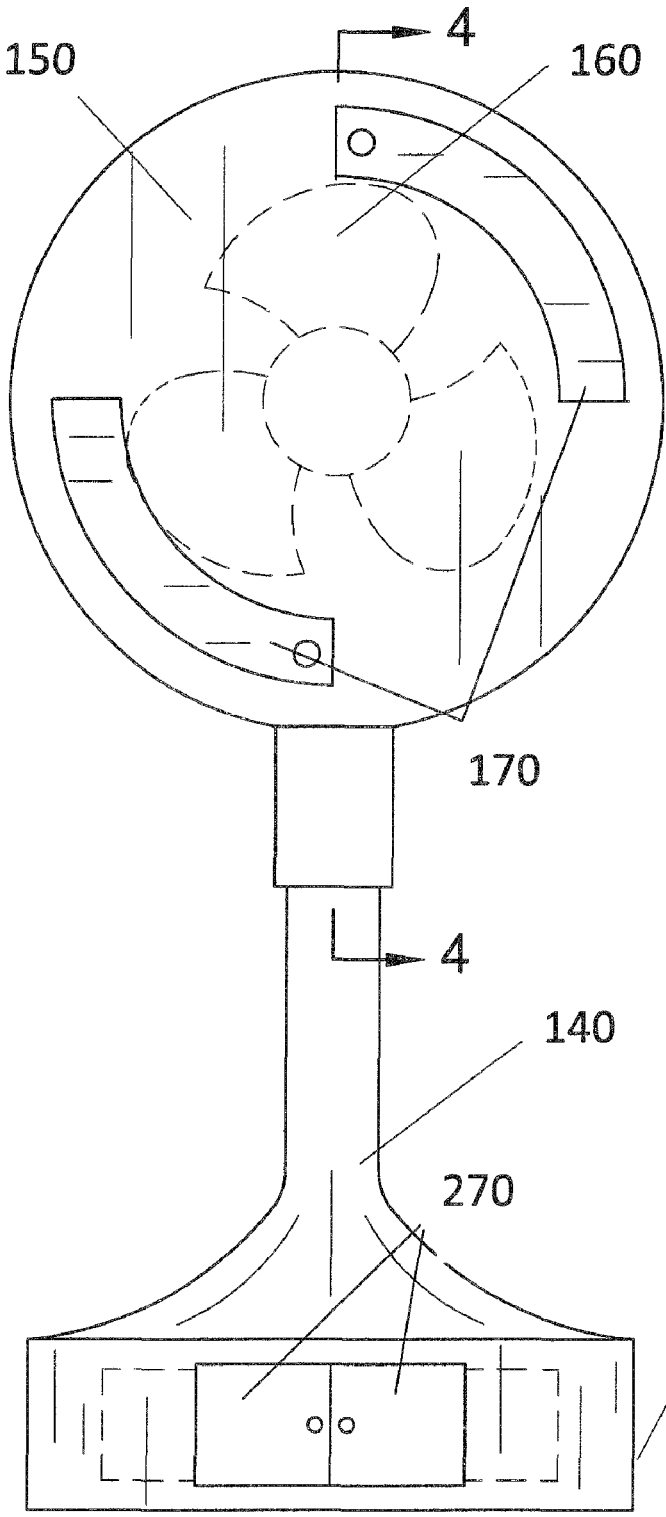
FIG. 3 is a back view and cut-away view of the fan device of FIG. 1.
Figure 4:
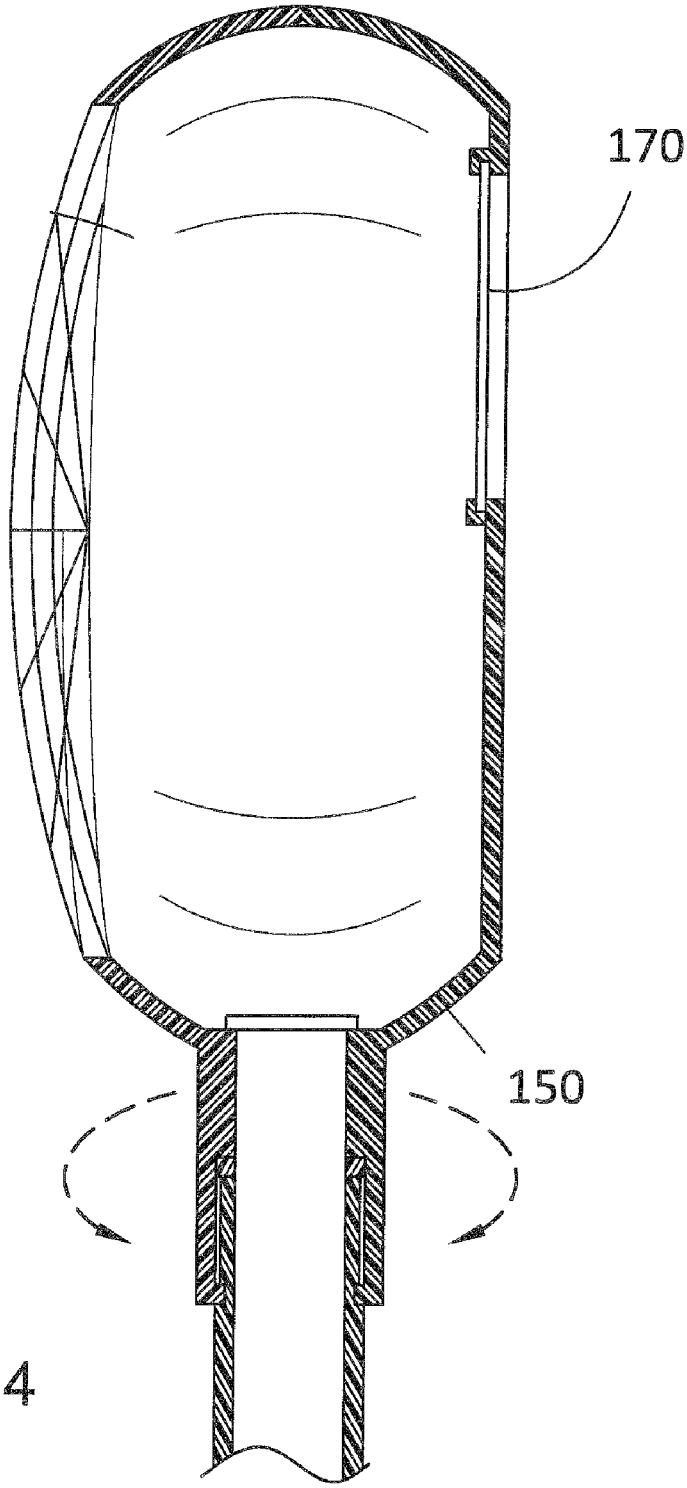
FIG. 4 is a side cross sectional view of the fan device of FIG. 1.
Figure 5:
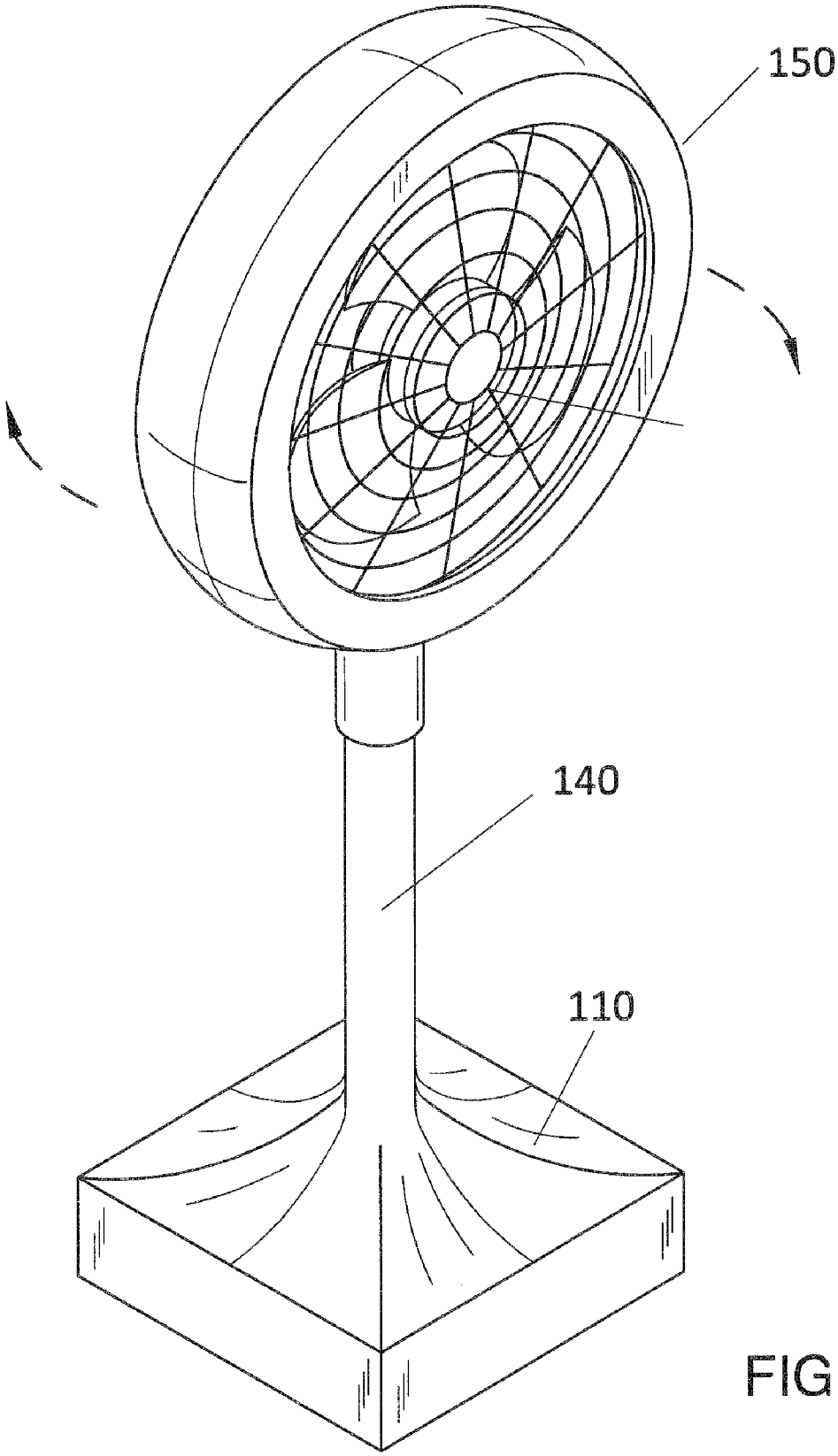
FIG. 5 is a perspective view of the fan device of the present invention, showing the ability of the fan device to rotate/pivot.
Figure 6:
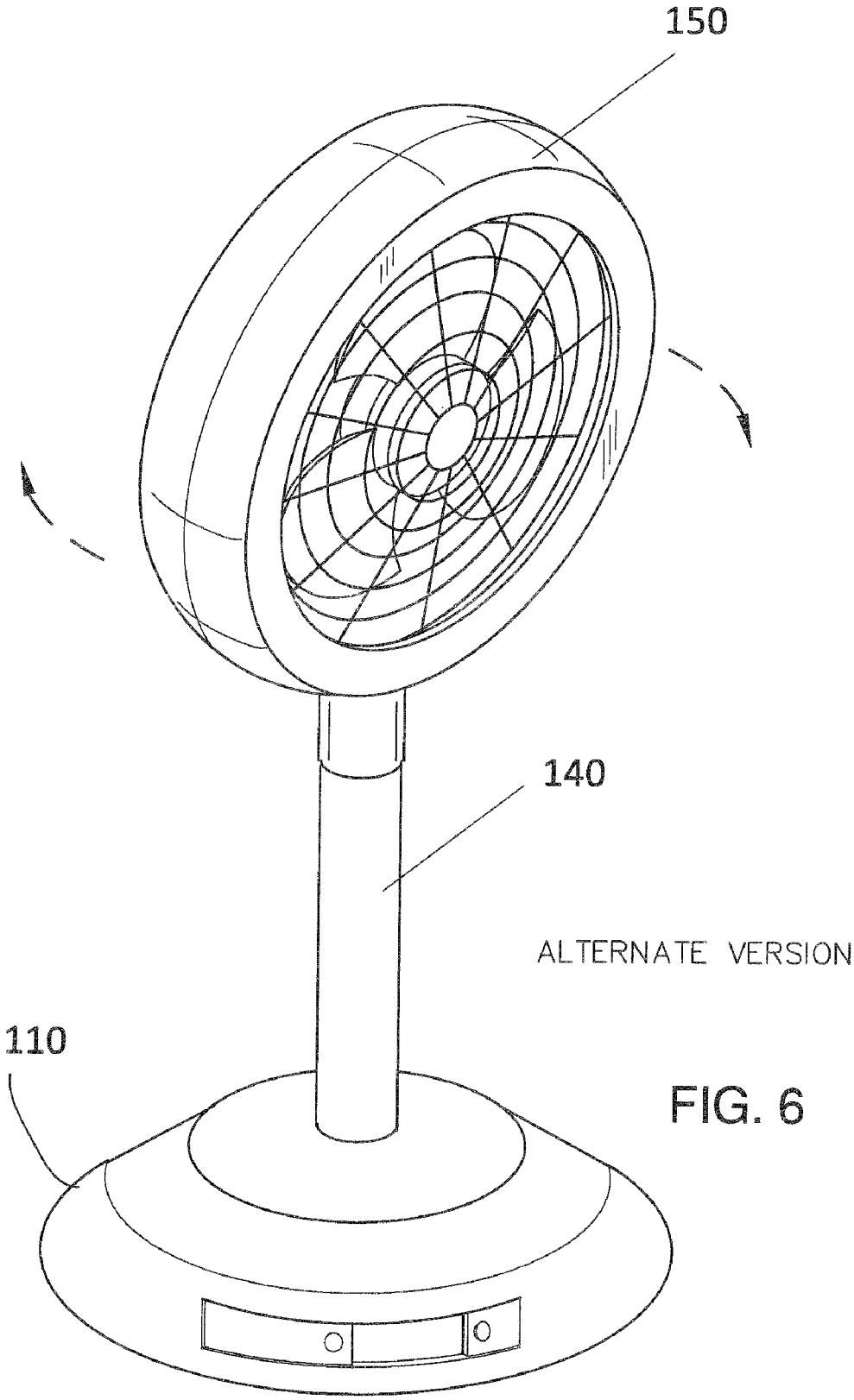
FIG. 6 is a perspective view of an alternative embodiment of the fan device of the present invention.

As shown in FIG. 3, in some embodiments, a second door component 270 is disposed in the base 110 (e.g., disposed in a side portion of the base 110). The second door component 270 can move between an open position and a closed position respectively allowing and preventing access (e.g., air access) to the inner cavity of the base 110. In some embodiments, the second door component 270 is a sliding door or a pair of sliding doors (see FIG. 3). In some embodiments, the second door component 270 is pivotally attached to the base 110. The second door component 270 is not limited to the aforementioned examples.

In some embodiments (e.g., see FIG. 8), a third door component 370 is disposed in the bottom surface 118 of the base 110. The third door component 370 can move between an open position and a closed position respectively allowing and preventing access (e.g., air access) to the inner cavity of the base 110. In some embodiments, the third door component 370 is a sliding door or a pair of sliding doors. The third door component 370 is not limited to the aforementioned examples.

Methods

The present invention also features methods of circulating air. The methods comprise obtaining the fan device of the present invention. In some embodiments, the fan device 100 is placed near an air source (e.g., including but not limited to an air vent of a HVAC system, a space heater, a window, etc.) and the fan device 100 is positioned such that the first door component 170 is near the air source. The first door component 170 can be opened and air from the air source (e.g., HVAC system, space heater) can flow into the inner cavity of the fan housing 150. The blades 160 (and motor, etc.) may draw the air from the air source and out of the open hole 158 in the fan housing 150. This provides increased circulation of the air coming from the air source (e.g., HVAC system, the space heater, etc). The present invention is not limited to use with an HVAC system or a space heater.

In some embodiments, the base 110 is placed near an air source (e.g., the second door component 270 being positioned near the air source). The second door component 270 can be opened and air from air source can flow into the inner cavity of the base 110. The blades 160 (and motor, etc.) draw the air from the inner cavity of the base 110 through the first support component 140 and out of the open hole 158 in the fan housing 150. This provides increased circulation of the air coming from the air source.

Figure 7:
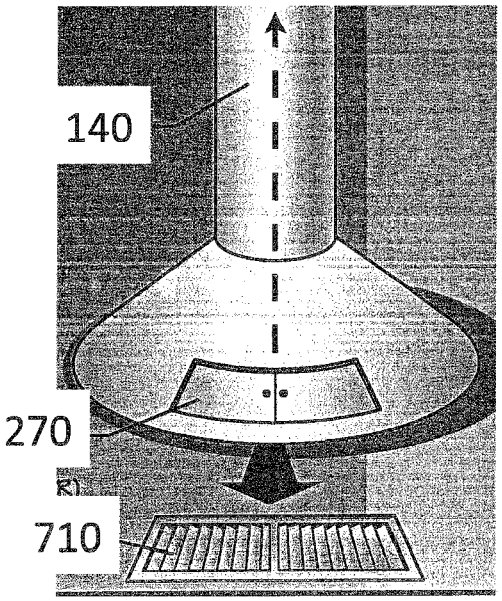
FIG. 7 is a perspective view of the base of the fan device of the present invention, wherein the base is placed atop a floor vent of a HVAC system.
Figure 8:
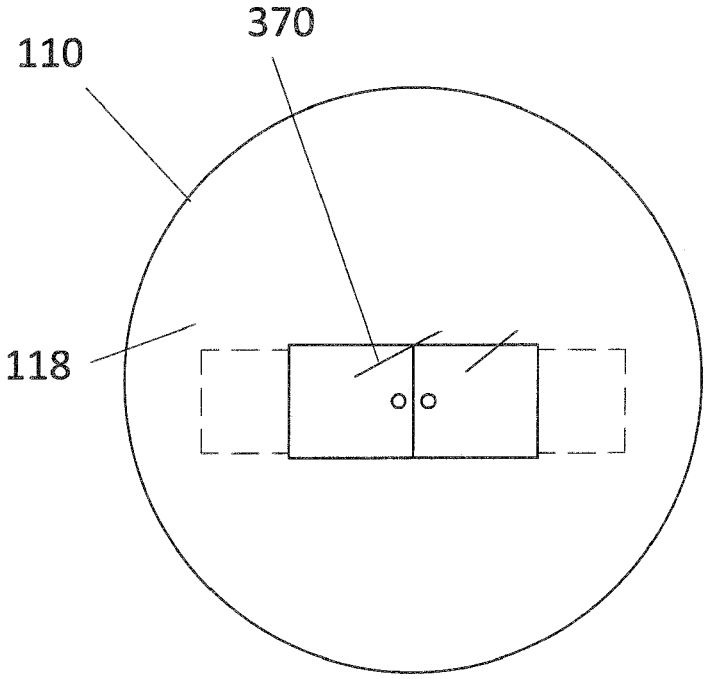
FIG. 8 is a bottom view of the base of the fan device of the present invention.

In some embodiments, for example as shown in FIG. 7, the base 110 is placed atop an air source (e.g., a floor vent 710 of a HVAC system). The third door component 370 can be opened and air from air source can flow into the inner cavity of the base 110. The blades 160 (and motor, etc.) draw the air from the inner cavity of the base 110 through the first support component 140 and out of the open hole 158 in the fan housing 150. This provides increased circulation of the air coming from air source (e.g., floor vent of HVAC system).

The following the disclosures of the following U.S. patents are incorporated in their entirety by reference herein: U.S. Pat. No. 6,322,443; U.S. Pat. No. 4,967,569; U.S. Pat. No. 4,250,800; U.S. Pat. No. 4,020,753; U.S. Pat. No. 5,722,483; U.S. Pat. No. 3,359,883; U.S. Pat. No. 2,824,575.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A pedestal fan device comprising:

(a) a pedestal base having an inner cavity;

(b) a support component having an inner cavity, the support component extending upwardly from the pedestal base;

(c) a fan housing mounted to a first end of the support component, the fan housing having an inner cavity, a front surface, and a back surface, wherein an open hole is disposed in the front surface and a plurality of fan blades are rotatably disposed in the inner cavity of the fan housing, wherein the plurality of fan blades are operatively connected to a motor that drives the rotation of the fan blades;

(d) a first door component disposed in the back surface of the fan housing, the first door component can move between an open position and a closed position respectively allowing and preventing air access to the inner cavity of the fan housing;

(e) a second door component disposed in a side portion of the pedestal base, the second door component can move between an open position and a closed position respectively allowing and preventing air access to the inner cavity of the pedestal base; and (f) a third door component disposed in a bottom surface of the pedestal base, the third door component can move between an open position and a closed position respectively allowing and preventing air access to the inner cavity of the pedestal base;

(g) wherein the inner cavity of the pedestal base is fluidly connected to the inner cavity of the support component and the inner cavity of the support component is fluidly connected to the inner cavity of the fan housing, such that when the second door component is in the open position, the fan blades induce a flow of air from an air source through the opened second door component into the inner cavity of the pedestal base, then into the inner cavity of the support component, then into the inner cavity of the fan housing, then out the open hole in the front surface of the fan housing, and, such that when the third door component is in the open position, the fan blades induce a flow of air from the air source through the opened third door component into the inner cavity of the pedestal base, then into the inner cavity of the support component, then into the inner cavity of the fan housing, then out the open hole in the front surface of the fan housing.

2. The pedestal fan device of claim 1, wherein the air source is a heating-ventilating-air conditioning (HVAC) system, a space heater, a window, or a combination thereof.

3. The pedestal fan device of claim 1, further comprising a weight disposed in the pedestal base for helping keep the fan device in an upright position.

4. The pedestal fan device of claim 1, wherein the pedestal base is constructed in a generally square shape, a generally circular shape, a generally triangular shape, a generally oval shape, or a generally pentagonal shape.

5. The pedestal fan device of claim 1 wherein a grate partially covers the open hole in the front surface of the fan housing.

6. The pedestal fan device of claim 1 wherein the first door component is a sliding door or a pair of sliding doors.

7. The pedestal fan device of claim 1 wherein the second door component is a sliding door or a pair of sliding doors.

8. The pedestal fan device of claim 1 wherein the third door component is a sliding door or a pair of sliding doors.

9. The pedestal fan device of claim 1 wherein the motor is operatively connected to a power source.

10. The pedestal fan device of claim 9, wherein the power source is a battery or an electrical outlet.

11. A method of circulating air, the method comprises:

(a) providing a fan device comprising:

(i) a pedestal base having an inner cavity; (ii) a support component having an inner cavity, the support component extending upwardly from the pedestal base; (iii) a fan housing mounted to a first end of the support component, the fan housing having an inner cavity, a front surface, and a back surface, wherein an open hole is disposed in the front surface and a plurality of fan blades are rotatably disposed in the inner cavity of the fan housing, wherein the plurality of fan blades are operatively connected to a motor that drives the rotation of the fan blades; (iv) a first door component disposed in the back surface of the fan housing, the first door component can move between an open position and a closed position respectively allowing and preventing air access to the inner cavity of the fan housing; (v) a second door component disposed in a side portion of the pedestal base, the second door component can move between an open position and a closed position respectively allowing and preventing air access to the inner cavity of the pedestal base; and (vi) a third door component disposed in a bottom surface of the pedestal base, the third door component can move between an open position and a closed position respectively allowing and preventing air access to the inner cavity of the pedestal base; (vii) wherein the inner cavity of the pedestal base is fluidly connected to the inner cavity of the support component and the inner cavity of the support component is fluidly connected to the inner cavity of the fan housing, such that when the second door component is in the open position, the fan blades induce a flow of air from an air source through the opened second door component into the inner cavity of the pedestal base, then into the inner cavity of the support component, then into the inner cavity of the fan housing, then out the open hole in the front surface of the fan housing, and, such that when the third door component is in the open position, the fan blades induce a flow of air from the air source through the opened third door component into the inner cavity of the pedestal base, then into the inner cavity of the support component, then into the inner cavity of the fan housing, then out the open hole in the front surface of the fan housing;

(b) positioning the second door component of the fan device next to the air source; and (c) opening the second door component, and causing the fan blades to induce a flow of air from an air source through the opened second door component into the inner cavity of the pedestal base, then into the inner cavity of the support component, then into the inner cavity of the fan housing, then out the open hole in the front surface of the fan housing.

12. The method of circulating air of claim 11, wherein the air source is a heating-ventilating-air conditioning (HVAC) system, a space heater, a window, or a combination thereof.

13. The method of circulating air of claim 11, wherein the fan device further comprises a weight disposed in the pedestal base for helping keep the fan device in an upright position.

14. The method of circulating air of claim 11, wherein the second door component is a sliding door or a pair of sliding doors.

15. The method of circulating air of claim 11, wherein the motor is operatively connected to a battery or an electrical outlet.

16. A method of circulating air, the method comprises:

(a) providing a fan device comprising:

(i) a pedestal base having an inner cavity; (ii) a support component having an inner cavity, the support component extending upwardly from the pedestal base; (iii) a fan housing mounted to a first end of the support component, the fan housing having an inner cavity, a front surface, and a back surface, wherein an open hole is disposed in the front surface and a plurality of fan blades are rotatably disposed in the inner cavity of the fan housing, wherein the plurality of fan blades are operatively connected to a motor that drives the rotation of the fan blades; (iv) a first door component disposed in the back surface of the fan housing, the first door component can move between an open position and a closed position respectively allowing and preventing air access to the inner cavity of the fan housing; (v) a second door component disposed in a side portion of the pedestal base, the second door component can move between an open position and a closed position respectively allowing and preventing air access to the inner cavity of the pedestal base; and (vi) a third door component disposed in a bottom surface of the pedestal base, the third door component can move between an open position and a closed position respectively allowing and preventing air access to the inner cavity of the pedestal base; (vii) wherein the inner cavity of the pedestal base is fluidly connected to the inner cavity of the support component and the inner cavity of the support component is fluidly connected to the inner cavity of the fan housing, such that when the second door component is in the open position, the fan blades induce a flow of air from an air source through the opened second door component into the inner cavity of the pedestal base, then into the inner cavity of the support component, then into the inner cavity of the fan housing, then out the open hole in the front surface of the fan housing, and, such that when the third door component is in the open position, the fan blades induce a flow of air from the air source through the opened third door component into the inner cavity of the pedestal base, then into the inner cavity of the support component, then into the inner cavity of the fan housing, then out the open hole in the front surface of the fan housing;

(b) positioning the third door component on top of the air source; and (c) opening the third door component and causing the fan blades to induce a flow of air from an air source through the opened third door component into the inner cavity of the pedestal base, then into the inner cavity of the support component, then into the inner cavity of the fan housing, then out the open hole in the front surface of the fan housing.

17. The method of circulating air of claim 16, wherein the air source is a heating-ventilating-air conditioning (HVAC) system, a space heater, a window, or a combination thereof.

18. The method of circulating air of claim 16, wherein the fan device further comprises a weight disposed in the pedestal base for helping keep the fan device in an upright position.

19. The method of circulating air of claim 16, wherein the second door component is a sliding door or a pair of sliding doors.

20. The method of circulating air of claim 16, wherein the motor is operatively connected to a battery or an electrical outlet.

* * * * *